United States Patent [19]

Utter et al.

[11] Patent Number: 4,497,184

[45] Date of Patent: Feb. 5, 1985

[54] AUGER-TYPE ICE MAKING APPARATUS FOR PRODUCING HIGH QUALITY ICE

[75] Inventors: Robert P. Utter; David A. Tandeski, both of Albert Lea, Minn.

[73] Assignee: King Seeley Thermos Company, Prospect Heights, Ill.

[21] Appl. No.: 440,468

[22] Filed: Nov. 9, 1982

Related U.S. Application Data

[63] Continuation of Ser. No. 171,356, Jul. 23, 1980, abandoned.

[51] Int. Cl.[3] ..... F25C 1/14

[52] U.S. Cl. ..... 62/354; 100/117

[58] Field of Search ..... 62/354; 100/117

[56] References Cited

U.S. PATENT DOCUMENTS

| | | | |
|---|---|---|---|
| 530,526 | 12/1894 | Holden | 62/354 X |
| 3,196,624 | 7/1965 | Reynolds | 62/354 X |
| 3,196,628 | 7/1965 | Reynolds | 62/354 X |
| 3,276,223 | 10/1966 | Lunde | 62/354 X |
| 3,354,666 | 11/1967 | Beusch et al. | 62/354 |
| 3,593,539 | 7/1971 | Fiedler | 62/354 |
| 4,198,831 | 4/1980 | Barnard et al. | 62/354 X |

*Primary Examiner*—William E. Tapolcai

*Attorney, Agent, or Firm*—Harness, Dickey and Pierce

[57] ABSTRACT

An apparatus for producing relatively uniform size high quality ice particles comprising a generally cylindrically-shaped ice forming chamber, a rotatable auger disposed in said chamber and adapted to cause ice formed on the inner side thereof to be formed into a generally cylindrically-shaped ice body, an ice discharge member disposed at one end of said chamber and being provided with a plurality of circumferentially arranged ice discharge openings overlying said cylindrical body, whereby rotation of said auger causes said cylindrical body to move toward and into engagement with said ice discharge member so that portions of said body are forced into said openings and are thereby compacted to remove ice make-up water therefrom, the dimensions of said openings being selected so that flow passages are provided between peripheral portions of the ice body moving through the ice discharge openings and the peripheral walls of said openings to permit ice make-up water to flow back toward the freezing chamber.

24 Claims, 6 Drawing Figures

56
64
60
70
66
16
58
90
20
50
10
52
62
74
74
44
46
76
54
48
52
42
78
78
40
30
12
36
28
26
14
34
32
24
22
18
38

AUGER-TYPE ICE MAKING APPARATUS FOR PRODUCING HIGH QUALITY ICE

This application is a continuation of application Ser. No. 171,356, filed July 23, 1980, now abandoned.

BACKGROUND OF THE INVENTION

There are two general types of ice making machines known in the prior art. The first and possibly the most familiar of these machines involves placing water into ice forming chambers or molds and subjecting the molds to the action of a refrigerant or a refrigeration system until the water is frozen into ice in cube or other suitable form. While machines of this general type produce high quality ice, they are by their very nature, relatively inefficient. This inefficiency is a result of the poor heat transfer characteristics of the ice itself, which necessitates significant refrigeration efforts in order to freeze a relatively thick piece of ice by direct heat transfer alone.

The second principal type of ice making machines known in the prior art is one in which ice is scraped from a freezine surface to provide ice in slush form which is subsequently compressed or compacted. A machine of this general type is disclosed in U.S. Pat. No. 3,034,311, issued May 15, 1962, to M. L. Nelson. While a machine of this type in which slush ice is forced through a plurality of openings in order to compress or compact the ice and remove water therefrom is much more efficient than conventional ice cube making equipment discussed above, such latter type of equipment has heretofore been known to produce ice which is inferior in quality to that produced on cube-type ice making equipment. In the art of manufacturing cubes or chunks of ice of various shapes, a definite distinction is made in the art between cube ice, such as that produced on the conventional machines first discussed above, and flake ice formed under pressure, since the former is hard and clear and regular in nature, while flake ice is produced in the form of irregular ice chunks which are not has hard or as clear as the ice produced on cube-type equipment.

The present invention is directed toward a new and improved flake-type ice making machine which overcomes a number of the deficiencies of similar type machines known in the prior art, and as such, the present invention is intended to produce a very high quality relatively uniform size particles of ice, as compared to the irregular low quality ice produced by prior art equipment. This is achieved in the present invention through the provision of a plurality of ice discharge openings which are formed in an ice discharge member located at the upper end of the ice forming chamber, with the openings being arranged in an overlying relationship with respect to the space between the root diameter of the auger and the inner diameter of the associated ice chamber wall. The size of the ice discharge openings are correlated with respect to the ice forming chamber such that as the generally cylindrically-shaped ice body produced by the ice auger is moved upwardly into engagement with the underside of the ice discharge member so that portions of the cylindrical body are forced upwardly through the ice discharge openings, water flow passages are provided between the inner peripheral wall of the discharge openings and the outer surface of the portions of ice moving through the openings. These passages permit water which is forced out of the ice body due to the compacting or ice extruding action of the cylindrical body of ice being pushed through the openings to flow back toward the ice chamber, resulting in a significantly higher quality ice. The ice rods which are produced as the cylindrical ice body is formed upwardly toward the ice discharge opening are adapted to engage a generally inwardly and upwardly inclined breaker ramp which causes the rods to break into relatively uniform length ice particles or pellets which are subsequently transferred via a suitable ice passage to an ice storage area or transport facility, as will hereinafter be described in detail.

SUMMARY OF THE INVENTION

This invention relates generally to ice making equipment, and more particularly, to a new and improved flake ice-type machine.

It is accordingly a general object of the present invention to provide a new and improved ice making apparatus.

It is a more particular object of the present invention to provide a new and improved ice making apparatus of the type which incorporates a freezing chamber having a rotatable auger disposed therein, the flight of which is disposed closely adjacent the chamber wall and functions to scrape ice formed thereon and simultaneously bias a cylindrical column or body of ice inwardly toward a plurality of ice discharge openings.

It is another object of the present invention to provide a new and improved apparatus for producing high quality ice of the above character wherein the ice which is forced through the ice discharge openings defines water flow passages with the periphery of the openings to permit excess water to flow back toward the ice forming chamber, resulting in ice being produced which has a significantly lower water content than ice produced by similar machines of the prior art.

It is yet another object of the present invention to provide a new and improved ice making machine which may be conveniently mounted in an associated cabinet structure or the like and which incorporates a spout for communicating ice pellets from the ice maker, the spout being mounted so that it may be conveniently oriented to accommodate various installations.

It is yet another object of the present invention to provide a new and improved ice making apparatus of the above character which minimizes to the extreme radial loading on the bearings for the rotatable ice auger.

It is still a further object of the present invention to provide a new and improved ice making apparatus of the above character wherein the size of the ice particles or pellets produced thereby are of a relatively uniform size.

It is yet another object of the present invention to provide a new and improved method of forming ice using the above-described apparatus.

Other objects and advantages of the present invention will become apparent from the following description taken in conjunction with the accompanying drawings.

DETAILED DESCRIPTION OF THE PREFERRED EMBODIMENT

Figure 1:
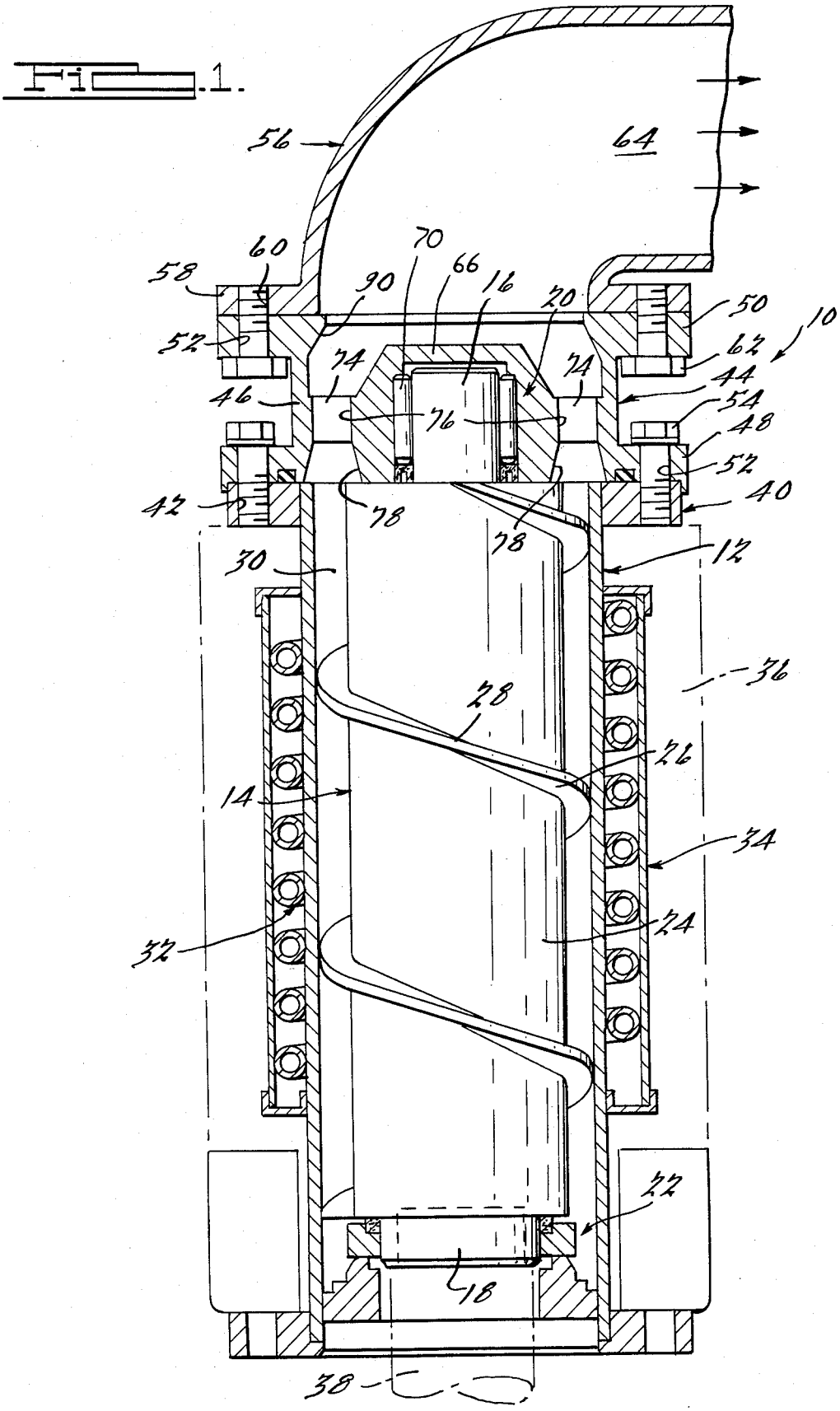
FIG. 1 is an enlarged cross-sectional view of the ice making apparatus of the present invention.
Figure 2:
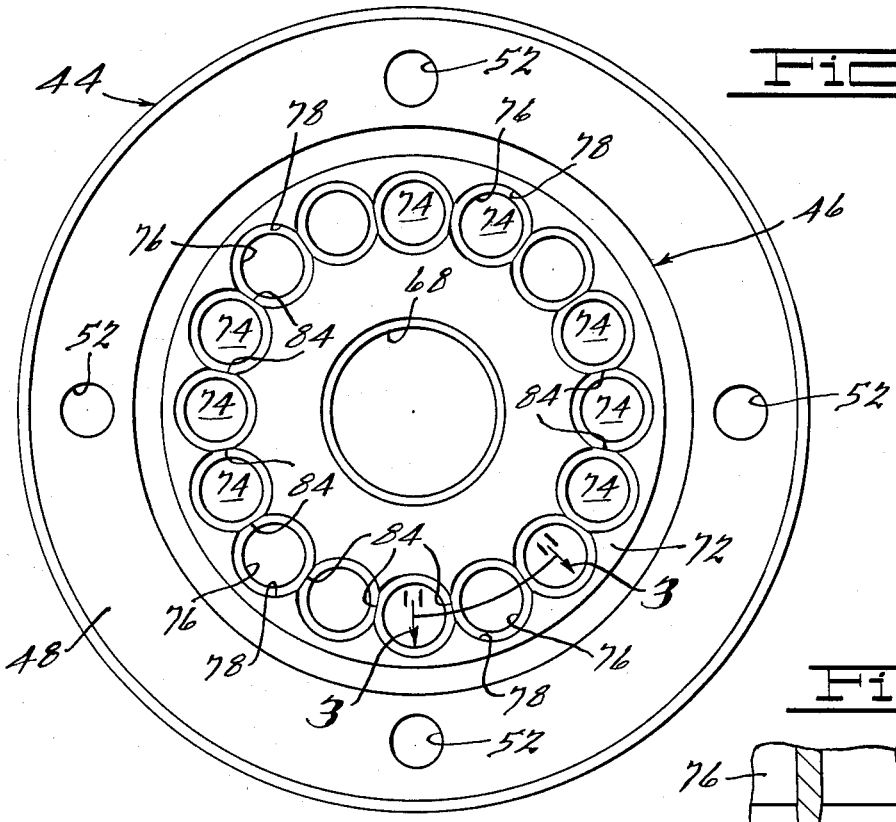
FIG. 2 is a bottom elevational view of the ice discharge member incorporated in the apparatus shown in FIG. 1.

Referring now in detail to the drawings and in particular to FIG. 1 thereof, an auger-type ice making machine 10, in accordance with one preferred embodiment of the present invention, is shown generally as comprising an elongated hollow cylindrical or tubular housing member 12 having auger means in the form of an elongated rotatable auger 14 disposed interiorly thereof. The auger 14 is formed with reduced diameter upper and lower end portions 16 and 18, respectively, which are supported for rotational movement, as seen generally at 20 and 22. The auger 14 comprises an elongated generally cylindrically-shaped central body section 24 that is formed with an integral helical ramp or flight 26 which defines a helical ice shearing edge 28 disposed closely adjacent the inner peripheral wall of the tubular housing member 12. The outer periphery of the auger 24 body, i.e., root diameter, and the inner periphery of the housing 12 define an ice forming chamber about which a refrigeration coil 32 is disposed. The coil 32 is arranged within a shroud or enclosure 34 which is in turn located interiorly of a suitable layer of a heat insulating material or the like, representatively designated by the numeral 36. As is well known in the art, a supply of ice make-up water is adapted to be communicated to the ice forming chamber 30 through suitable water conduit means (now shown), whereupon energization of an associated refrigeration system causes refrigerant to flow through the coil 32 to effect a thin layer of ice being continuously formed around the inner periphery or surface of the tubular member 12. Upon rotation of the auger 14 by means of a suitable drive motor or the like (not shown) which is drivingly connected to the auger 14 by means of a drive shaft 38, the aforesaid layer of ice is transferred axially upwardly by the helical ramp 26, whereupon said ice will be formed into a generally cylindrical or tubular-shaped ice body having a radial thickness or dimension equal to the radial space between the inner periphery of the housing member 12 and the root diameter of the auger 14. This cylindrical body of ice is representatively designated by the numeral I in FIGS. 4 and 5 and is moved upwardly within the chamber 30 under the influence of the rotating auger flight 26, the uppermost portion of the ice body I being subjected to a compacting and forming operation resulting in the ice being formed into discrete ice particles or pellets, one of which is illustrated in FIG. 6, as will hereafter be described.

Disposed adjacent the upper end of the cylindrical housing member 12 is an annular mounting flange 40 formed with a plurality of internally threaded apertures 42. The mounting flange 40 is adapted to function operatively supporting an ice extruder and breaker member generally designated by the numeral 44 upon the upper end of the housing member 12. More specifically, the member 44 comprises a generally cylindrical body 46 having a radial outwardly extending mounting flange 48 formed integrally of the lower end thereof and adapted to be surmounted upon the flange 40 in the manner best illustrated in FIG. 1. The cylindrical body 46 is also formed with an upper attachment flange 50, with the flanges 48, 50 being provided with suitable bores 52, whereby mounting bolts or the like 54 may be used for fixedly securing the bracket member 44 upon the flange 40. Disposed directly above the member 44 is an ice discharge elbow 56 having a suitable mounting flange or the like 58 provided with apertures 60, whereby attachment bolts or the like 62 may be utilized for operatively securing the discharge elbow 56 upon the upper end of the ice extruder and breaker member 44.

Generally speaking, the cylindrical body of ice I which is biased upwardly under the influence of the rotating auger 14 is subjected to the ice compacting or extruding operation of the member 44, whereupon relatively uniform size, high quality ice particles or pellets are produced thereby, the ice particles or pellets moving upwardly into the elbow 56 along a discharge path 64, whereupon the ice may be transmitted to a suitable ice storage area, either adjacent or remote from the machine 10. It is to be noted that the mounting arrangement for the elbow 56 upon the member 44 is disclosed herein merely by way of depicting a suitable way of attaching the elbow 56 in its operative position, and various other mounting arrangements may be utilized without departing from the scope of the present invention. It is contemplated, for example, that the elbow 56 could be rotatably or adjustably mounted upon the top of the member 44 so that it may be conveniently positioned to accommodate various installations. It should also be noted that suitable sealing means, such as O-ring sealing elements or the like may be provided interjacent confronting surfaces of the member 44 with the associated flange 40 and/or elbow 56, as illustrated, to preclude undesirable water leakage, as is well known in the art.

The ice extruder and breaker member 44 includes a central section 66, the underside of which is formed with an annular blind bore or cavity 68. As best seen in FIG. 1, a suitable anti-friction bearing assembly, generally designated by the numeral 70, is disposed within the bore 68 and adapted to rotatably support the reduced diameter upper end portion 16 of the auger 14.

Disposed radially outwardly from the central section 66 of the member 44 is an intermediate body portion, generally designated by the numeral 72 and which is arranged generally axially above or in overlying relationship with respect to the ice forming chamber 30. In accordance with the principles of the present invention, the body portion 72 is formed with a plurality of circumferentially spaced, axially extending ice discharge openings which extend from the underside of the member 44, i.e., the side of the member 44 confronting the ice forming chamber 30, to the open upper side of the member 44, as best seen in FIG. 1. The plurality of openings 74 are identical in size and shape and are arranged such that the central axis of each of the openings 74 is located on an imaginary circle, the center of which is coaxial with the axis of the auger 14 and housing member 12 and the diameter of which is greater than the root diameter of the auger 14 and smaller than the inner diameter of the housing member 12. In a preferred construction of the present invention, the diameter of the aforesaid imaginary circle, designated by the letter C in FIG. 5, is such that the center of each of the openings 74 is spaced radially between, i.e., midway or equidistant, from the root diameter of the auger 14 and the inner peripheral wall of the housing member 12.

Figure 3:
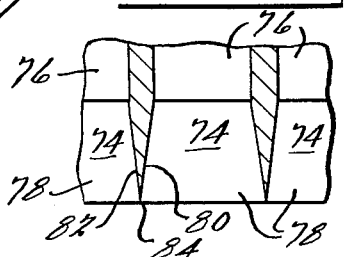
FIG. 3 is an enlarged fragmentary cross-sectional view taken substantially along the line 3—3 of FIG. 2.
Figure 4:
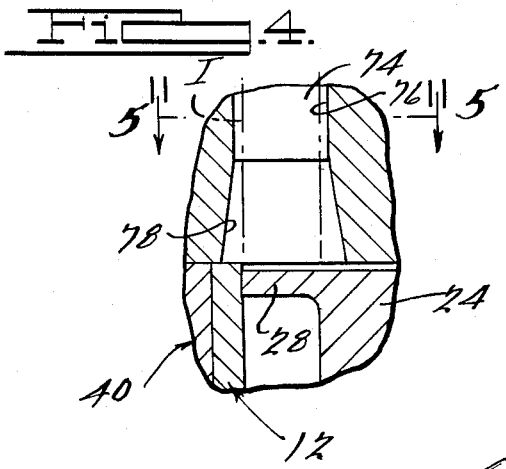
FIG. 4 is a fragmentary cross-sectional view illustrating a portion of the ice auger and one of the associated ice discharge openings.
Figure 5:
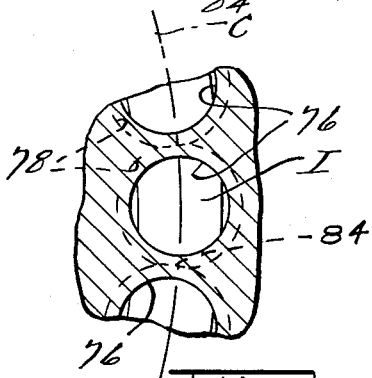
FIG. 5 is a fragmentary cross-sectional view taken substantially along the line 5—5 of FIG. 4.
Figure 6:
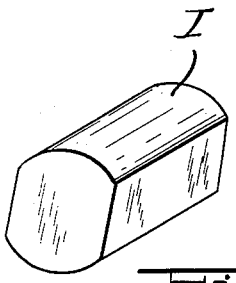
FIG. 6 is an elevated perspective view of one of the ice particles produced by the ice making machine of the present invention.

As best seen in FIGS. 3–5, each of the ice discharge openings 74 comprises an upper cylindrical section 76 and a lower tapered or frusto-conical section 78, with the sections 76, 78 of each of the openings 74 being coaxial, as shown. As depicted in FIG. 3, the circumferential spacing of the ice discharge opening 74 is such that the tapered lower sections thereof define downwardly converging surfaces 80 and 82 between each adjacent pair of the openings 74, the surfaces 80, 82 converging at a generally radially disposed ice shearing edge 84 between each adjacent pair of openings 74, with the edges 84 lying in a radial plane defining the upper axial end of the ice forming chamber 30 and co-planar with the lower side of the ice extruder and breaker member 44. In a preferred form of the present invention, the lower tapered sections 78 of the discharge openings 74 are defined by an included angle with respect to the axes of the openings 74 of between 15°–25°, and preferably approximately 20°. Also in accordance with a preferred form of the present invention, the desired high quality ice is achieved when the diameter of the openings 74 and in particular, the diameter of the upper sections 76 thereof, is related to the radial thickness of the ice body I, or in other words, to the radial spacing between the root diameter of the auger 14 and the inner diameter of the housing member 12. Specifically, the diameter of the upper section 76 of each of the openings 74 is preferably equal to approximately 1.2 times the radial thickness of the ice cylinder I or the radius of the inner surface of the housing member 12 less the root diameter of the auger 14. One exemplary embodiment of the present invention consists of the ice extruder and breaker member 44 having 16 equally circumferentially spaced ice discharge openings 74 which are arranged around the circumference of the circle C having a diameter of 2.66", with the diameter of the upper sections 76 of the openings 74 being 0.437", the diameter of the lowermost portions of the lower sections 78 being 0.550" and the lower section 78 having a taper of 20° (included angle), and the associated ice cylinder having a radial thickness of 0.312".

In accordance with the principles of the present invention, as the cylindrical ice body I is biased upwardly toward and into engagement with the underside of the member 44 under the influence of the auger 14, the upper end of the ice body is divided into equal segments or rods by the edges 84 between adjacent discharge openings 74. These segments or rods are biased vertically upwardly by the upwardly moving ice cylinder, whereupon the ice is compacted so that the rods maintain their shape as they are forced upwardly through the openings 74 into the area directly thereabove. As shown in FIG. 1, a generally radial inwardly and upwardly inclined ramp or surface 90 is formed around the interior of the upper side of the member 44 in general overlying relation with respect to the upper sections 76 of the openings 74 as the aforementioned ice rods emanating from the upper ends of the openings 74 engage the ramp 90, the rods will be broken off or fractured into relatively uniform length ice particles or pellets which will be subsequently urged under the influence of subsequently formed pellets along the flow path 64 to an associated ice storage area (not shown).

With reference to FIGS. 4 and 5 and in accordance with the present invention, by virtue of the fact that the diameter of the upper sections 76 of the openings 74 is slightly greater than the radial thickness of the cylindrical ice body I, the ice rods which are formed as the ice moves through the openings 74 will have portions on the radially inner and outer sides thereof spaced away from the adjacent peripheral wall of the openings 74, which spaces comprise water flow passages which permit excess water within the ice body and which is forced therefor during the compacting and extruding process taking place as the ice body is forced upwardly through the openings 74, to pass downwardly back toward the interior of the ice forming chamber 30 where it may be used as subsequent ice make-up water. The provision of the aforesaid flow passages permits significantly greater amount of water to be out of the ice rods than has been possible in the prior art designs, with the result that the quality of the ice produced by the present invention is remarkably higher or greater than that achieved by prior known apparatus. In particular, the quality of the ice produced by the present invention is of a magnitude of 80–85%, whereas the quality of prior art type flaked ice equipment is of the magnitude of 60–65%. Accordingly, the present invention has the ability to produce a very high quality ice without the attendant inefficiencies of standard ice making equipment hereinbefore described.

Together with the above discussed advantages of being able to provide high quality ice in particular or pellet form, the present invention is also advantageous from the standpoint that radial loading on the auger bearings is minimized to the extreme by virtue of the fact that cylindrical ice body I is forced upwardly through the discharge openings 74, as distinguished from side exiting machines of the prior art. Moreover, by permitting the discharge elbow 56 to be selectively rotatably mounted upon the upper end of the ice making machine 10, universality of installation will be achieved. Also, by having the ice extruder and breaker member 44 consist of a separate integral member, convenient replacement and interchangeability may be accomplished for purposes of inspection, repair and enabling variation in the size of the ice pellets produced.

While it will be apparent that the preferred embodiment of the invention disclosed is well calculated to fulfill the objects above stated, it will be appreciated that the invention is susceptible to modification, variation and change without departing from the proper scope or fair meaning of the subjoined claims.

We claim:

1. An apparatus for producing high quality relatively uniform size ice particles or pellets, comprising, means for producing an ice body comprising a generally hollow cylindrically-shaped ice forming chamber, said ice body having a generally cylindrical cross-sectional shape and having radially inner and outer sides, ice auger means within said chamber and cooperable therewith for causing said ice body to move toward and into engagement with an ice discharge element defining a generally axially extending ice discharge opening, said opening being arranged directly above said ice body whereby a section of said body moves through said opening upon upward movement of said body, said discharge opening having a dimension measured radially of said chamber that is greater than the radial thickness of said ice body, whereby the section of said body moving through said opening has at least one side thereof spaced away from the wall of said opening so as to define a flow passage through which unfrozen water within said body may flow through said opening back toward said ice producing means.

2. The invention as set forth in claim 1 wherein said discharge opening causes said section of said ice body to be compressed into a rod-like shape as it is forced through said opening.

3. The invention as set forth in claim 2 wherein said ice discharge opening is of a circular configuration and of a diameter greater than the radial thickness of said body.

4. The invention as set forth in claim 1 which includes refrigeration means adjacent said chamber, means for supplying ice make-up water to said freezing chamber, wherein said auger comprises a body portion having a diameter less than the internal diameter of said chamber to provide a space therebetween, said auger having a spiral flight in said space, the edge of which flight is positioned closely adjacent the inner surface of said chamber.

5. The invention as set forth in claim 3 which comprises an ice discharge member adjacent the upper end of said chamber and defining said discharge opening at a position overlying said flight.

6. The invention as set forth in claim 5 wherein the diameter of said discharge opening is greater than the radial dimension between the inner diameter of said chamber and the root diameter of said auger.

7. The invention as set forth in claim 4 wherein said ice discharge element is formed with a plurality of circumferentially spaced, axially extending discharge openings, said openings having their respective axes arranged around an imaginary circle, the center of which imaginary circle is coaxial with the axis of said auger and the diameter of which imaginary circle is greater than the root diameter of said auger and smaller than the inner diameter of said chamber.

8. The invention as set forth in claim 7 which includes a radially inwardly and upwardly inclined ice breaker ramp disposed above said openings for causing ice in rod-like shape moving upwardly from said opening to be deflected inwardly and break off into substantially uniform size particles.

9. The invention as set forth in claim 7 wherein said ice discharge openings each comprises a uniform diameter upper cylindrical portion and a generally tapered frusto-conical lower section.

10. The invention as set forth in claim 9 wherein the lower end of each of said discharge openings is tapered at an angle of between 15° and 25°.

11. The invention as set forth in claim 10 wherein the lower end of each of said discharge openings is tapered at an angle of approximately 20°.

12. The invention as set forth in claim 9 wherein the diameter of said upper section of said discharge opening is equal to approximately 1.2 times the radial spacing between the inner diameter of said chamber and the root diameter of said auger.

13. The invention as set forth in claim 7 wherein said ice discharge member comprises a central blind bore section within which the upper end of said auger is rotatably received.

14. The invention of claim 1 wherein said discharge passage comprises an upwardly tapered lower section and upper section of substantially uniform cross-section of the same size as the upper end of said lower section.

15. The invention set forth in claim 1 wherein said ice discharge element defines a plurality of circumferentially spaced axially extending openings in a circle the center of which is coaxial with the axis of said ice auger means, each opening having a dimension measured radially of said chamber that is greater than the radial thickness of said ice body, whereby the sections of said body moving through said openings each have at least one side which is spaced away from the wall of the corresponding plurality of flow passages through which unfrozen water within said body may flow through said openings back toward said ice producing means.

16. The invention of claim 15 wherein openings have downwardly and outwardly flared lower end portions which divide the ice body into a corresponding plurality of circumferentially arranged rod-like bodies the circumferential dimensions of which are progressively reduced as the bodies are moved upwardly through the flared portions to thereby remove unfrozen water therefrom.

17. The invention as set forth in claim 7 wherein said ice discharge element is formed with a plurality of circumferentially spaced, axially extending discharge openings, said openings having their respective axes arranged around an imaginary circle, the center of which imaginary circle is coaxial with the axis of said auger and the diameter of which imaginary circle is greater than the root diameter of said auger and smaller than the inner diameter of said chamber.

18. The invention as set forth in claim 8 which includes a radially inwardly and upwardly inclined ice breaker ramp disposed above said openings for causing ice in rod-like shape moving upwardly from said opening to be deflected inwardly and break off into substantially uniform size particles.

19. The invention as set forth in claim 9 wherein said ice discharge openings each comprises a uniform diameter upper cylindrical portion and a generally tapered frusto-conical lower section.

20. The invention as set forth in claim 19 wherein the lower end of each of said discharge openings is tapered at an angle of between 15° and 25°.

21. The invention as set forth in claim 20 wherein the lower end of each of said discharge openings is tapered at an angle of approximately 20°.

22. The invention as set forth in claim 19 wherein the diameter of said upper section of said discharge opening is equal to approximately 1.2 times the radial spacing between the inner diameter of said chamber and the root diameter of said auger.

23. The invention as set forth in claim 17 wherein said ice discharge member comprises a central blind bore section within which the upper end of said auger is rotatably received.

24. The invention of claim 16 wherein openings have downwardly and outwardly flared lower end portions which divide the ice body into a corresponding plurality of circumferentially arranged rod-like bodies the circumferential dimensions of which are progressively reduced as the bodies are moved upwardly through the flared portions to thereby remove unfrozen water therefrom.

* * * * *

UNITED STATES PATENT AND TRADEMARK OFFICE

CERTIFICATE OF CORRECTION

PATENT NO. : 4,497,184

DATED : February 5, 1985

INVENTOR(S) : Robert P. Utter; David A. Tandeski

It is certified that error appears in the above-identified patent and that said Letters Patent is hereby corrected as shown below:

Column 1, line 41, "has" should be --as--

Column 2, line 6, "formed" should be --forced--

Column 2, line 29, "inwardly" should be --upwardly--

Column 3, line 8, "elevated" should be --enlarged--

Column 3, line 39, "now" should be--not--

Column 4, line 8, "bracket" should be --breaker--

Column 6, line 9, "therefor" should be --therefrom--

Column 6, line 28, "particular" should be --particle--

Signed and Sealed this

*Fifteenth* Day of *October 1985*

[SEAL]

*Attest:*

DONALD J. QUIGG

*Attesting Officer*

*Commissioner of Patents and Trademarks—Designate*